US005255601A

United States Patent [19]

Blass et al.

[11] Patent Number: 5,255,601

[45] Date of Patent: Oct. 26, 1993

[54] INTAGLIO PRINTING MACHINE WITH WIPING ROLL ADJUSTING DEVICE

[75] Inventors: Ernst A. Blass, Margetshöchheim; Hermann J. Kunh, Zellingen, both of Fed. Rep. of Germany

[73] Assignee: De la rue Giori S.A., Lausanne, Switzerland

[21] Appl. No.: 920,185

[22] Filed: Jul. 24, 1992

[30] Foreign Application Priority Data

Jul. 30, 1991 [CH] Switzerland ..... 2273/91

[51] Int. Cl.[5] ..... B41F 9/10

[52] U.S. Cl. ..... 101/155; 101/157; 101/425

[58] Field of Search ..... 101/153, 157, 155, 167, 101/169, 247, 425; 15/256.52

[56] References Cited

U.S. PATENT DOCUMENTS

| | | | |
|---|---|---|---|
| 2,659,305 | 11/1953 | Giori | 101/175 |
| 2,987,993 | 6/1961 | Giori | 101/155 |
| 3,389,656 | 6/1968 | Giori | 101/170 |
| 3,468,248 | 9/1969 | Giori | 101/167 |
| 3,630,146 | 12/1971 | Shields | 101/169 |
| 3,738,265 | 6/1973 | Saueressig | 101/157 |
| 3,762,319 | 10/1973 | Gazzola et al. | 101/155 |
| 4,499,825 | 2/1985 | Uno | 101/155 |
| 4,789,432 | 12/1988 | Goodnow et al. | 101/169 |
| 4,899,654 | 2/1990 | Hoshi | 101/167 |
| 5,152,220 | 10/1992 | Lindner et al. | 101/155 |

FOREIGN PATENT DOCUMENTS

| | | | |
|---|---|---|---|
| 42047 | 3/1985 | Japan | 101/169 |
| 793790 | 4/1958 | United Kingdom . | |

*Primary Examiner*—Edgar S. Burr
*Assistant Examiner*—Stephen R. Funk
*Attorney, Agent, or Firm*—Kane, Dalsimer, Sullivan, Kurucz, Levy, Eisele & Richard

[57] ABSTRACT

The wiping cylinder (10) is mounted in eccentric bushes (12) and can be coarsely adjusted by hydraulic cylinders (15), by which the eccentric bushes can be rotated, between its operating position resting on the plate cylinder (3) and a position of rest removed from the latter. Additionally, a fine adjustment is provided, by which the change in spacing between the axles of the plate cylinder and the wiping cylinder as a result of deflection of the plate cylinder (3) occurring during the engagement of the impression cylinder (2) can be compensated. For this purpose, the hydraulic cylinders (15) are each attached to a worm wheel (17) which can be rotated by a worm spindle (18). Serving for the fine adjustment of the worm spindle (18) is a stepping motor (19) which is adjusted simultaneously with the engagement and disengagement of the impression cylinder (2) in each case by a preselectable amount in either direction.

7 Claims, 3 Drawing Sheets

INTAGLIO PRINTING MACHINE WITH WIPING ROLL ADJUSTING DEVICE

FIELD OF THE INVENTION

The invention relates to an intaglio printing machine having a plate cylinder, an impression cylinder, which is equipped with an actuator for engagement and disengagement and can be adjusted by means of this actuator between an operating position resting on the plate cylinder and a position of rest removed from the latter, and having a wiping device which has a wiping cylinder which interacts with the plate cylinder and can likewise be adjusted by means of an actuator between an operating position, in which it rests on the plate cylinder with predetermined pressure, and a position of rest removed from said plate cylinder.

PRIOR ART

Intaglio printing machines of this type have been known for a long time. Wiping devices are described, for example, in the U.S. Pat. Nos. 3,389,656 and 3,468,248 and in the British Patent 793 790, and serve for completely cleaning the inked surface of the intaglio printing plates from all traces of ink prior to printing and, at the same time, filling the grooves satisfactorily with ink. In order to be able to set the pressure with which the wiping cylinder rests on the plate cylinder, it is known to mount the wiping cylinder in eccentric bearings (for example U.S. Pat. Nos. 2,659,305 and 4,899,654), so that the spacing of the wiping cylinder from the plate cylinder and thus the pressure of the wiping cylinder can be set by adjusting the eccentric bearing parts. A similar eccentric bearing is known for the impression cylinder in order to set the pressure with which it rests on the plate cylinder, and to remove the impression cylinder from the plate cylinder when the printing operation is interrupted.

One of the special features of intaglio printing is that the paper is printed with the exertion of a very great force. This is calculated to be about 10,000N impressional force per cm of printing width. This high impressional force, with which the impression cylinder has to be pressed against the plate cylinder and which can be up to 100 metric tons, results in the cylinder journals of the plate cylinder becoming slightly deflected, as a result of which the axle spacing between the impression cylinder and plate cylinder changes in each case on engagement and on disengagement of the impression cylinder. This change in the axle spacing is only insignificant if it does not cause a change in the pressure with which the wiping cylinder rests on the plate cylinder. This is because a precisely predetermined and constant pressure of the wiping cylinder is essential to achieve satisfactory wiping.

However, this pressure of the wiping cylinder is only virtually independent of a change to the axle spacing mentioned if the connecting line between the impression cylinder axle and the plate cylinder axle is precisely perpendicular to the connecting line between the plate cylinder axle and the wiping cylinder axle. This geometry can readily be implemented in two-plate and four-plate machines, but not in intaglio printing machines, whose plate cylinder bears a different number of plates, especially not in a three-plate machine. In a three-plate machine, as is illustrated diagrammatically in FIG. 1, the connecting line between the axles of the impression cylinder and plate cylinder encloses an angle of 120° with the connecting line between the axles of the plate cylinder and wiping cylinder. This geometry is necessary so that the point in time, at which in each case the leading edge, seen in the direction of rotation, of each printing plate on the plate cylinder comes into contact with the printing cover on the corresponding sector of the impression cylinder, coincides with that point in time at which the leading edge of a printing plate comes into contact with the wiping cylinder. Whenever the pressure between a printing plate and the impression cylinder, on the one hand, and a printing plate and the wiping cylinder, on the other hand, begins, the cylinders are subjected to jolts which do not impair the quality of the printing only if the condition described above is met.

As a result of the abovementioned geometry of a three-plate machine, on deflection of the cylinder journals of the plate cylinder a displacement component occurs in the direction of the wiping cylinder which can generally amount to a plurality of tenths of a millimeter and may possibly amount to approximately 1 millimeter, and which in an unfavorable manner causes the pressure with which the wiping cylinder rests on the plate cylinder to change. This results in the wiping conditions in the operating position and in the position of rest of the impression cylinder being different and thus the surface of the printing plates no longer being satisfactorily cleaned of ink after disengagement of the impression cylinder, with the result that waste sheets occur when the printing operation is recommenced.

It has been shown that the permissible tolerance of the spacing between the plate cylinder and wiping cylinder for constant satisfactory wiping is approximately 0.01 mm. Any required corrections of the setting of the position of the wiping cylinder relative to the plate cylinder have previously been carried out by hand, which is cumbersome and in which case substantial numbers of waste sheets had to be tolerated until the correct setting was achieved.

SUMMARY OF THE INVENTION

To remove the disadvantages described above, the underlying object of the present invention is to compensate in a simple manner the displacement component which influences the pressure of the wiping cylinder and occurs on deflection of the cylinder journals of the plate cylinder. Additionally, the operating convenience in setting and adjusting the wiping cylinder is to be improved by the invention.

This object is achieved according to the invention by the features specified in the characterizing part of claim 1.

Due to this adjustment of the wiping cylinder taking place simultaneously with the engagement or disengagement of the impression cylinder, said wiping cylinder practically trails the plate cylinder on displacement thereof, by which means the pressure of the wiping cylinder is kept virtually constant both in the operating position and in the position of rest of the impression cylinder. The simultaneous adjustment of the impression cylinder and wiping cylinder can take place either by a common command generator, in which the setting path of the fine actuator in either direction is determined by a preselected value; or there are provided a force measuring device for measuring the pressing force between the impression cylinder and the plate cylinder and a stored-program control system which controls the adjustment of the wiping cylinder as a function of the measured value supplied.

If, as is customary, cleaning elements are provided on the wiping cylinder, they are preferably likewise adjustable by the fine actuator in such a way that their position relative to the wiping cylinder is at least approximately maintained. As a result, the correct contact of the cleaning elements and thus satisfactory cleaning of the wiping cylinder are guaranteed.

Preferred designs of the invention result from the dependent patent claims.

BRIEF DESCRIPTION OF THE DRAWINGS

The invention is explained in detail by way of an exemplary embodiment of a sheet-fed printing machine with reference to the drawings, in which.

DESCRIPTION OF THE PREFERRED EMBODIMENT

Figure 1:
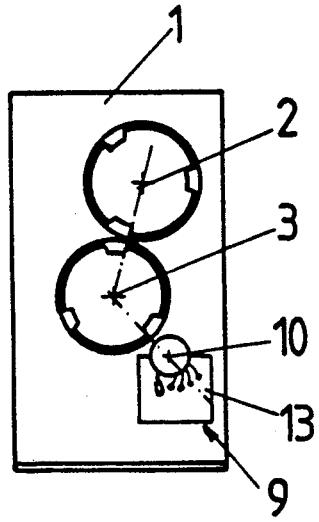
FIG. 1 shows a diagrammatic illustration of a three-plate machine.

According to FIG. 1, to which reference has already been made in the introduction, the intaglio printing machine has an impression cylinder 2 and a plate cylinder 3 which are both mounted in the machine frame 1. The plate cylinder 3 bears three evenly distributed printing plates, and the impression cylinder 2 correspondingly has three sectors on which printing covers are mounted. The wiping device 9, interacting with the plate cylinder 3, consists of a wetting trough 13, a wiping cylinder 10, cleaning elements resting on the wiping cylinder, and the devices shown in detail in FIGS. 2 and 3 for adjusting the wiping cylinder and the cleaning elements. The wiping cylinder 10 is immersed in a cleaning liquid located in the wetting trough 13, or its surface is sprayed with cleaning liquid via corresponding feed elements. As indicated in FIG. 1, the connecting line between the axles of the impression cylinder and plate cylinder encloses an angle of 120° with the connecting line between the axles of the plate cylinder and wiping cylinder.

Figure 2:
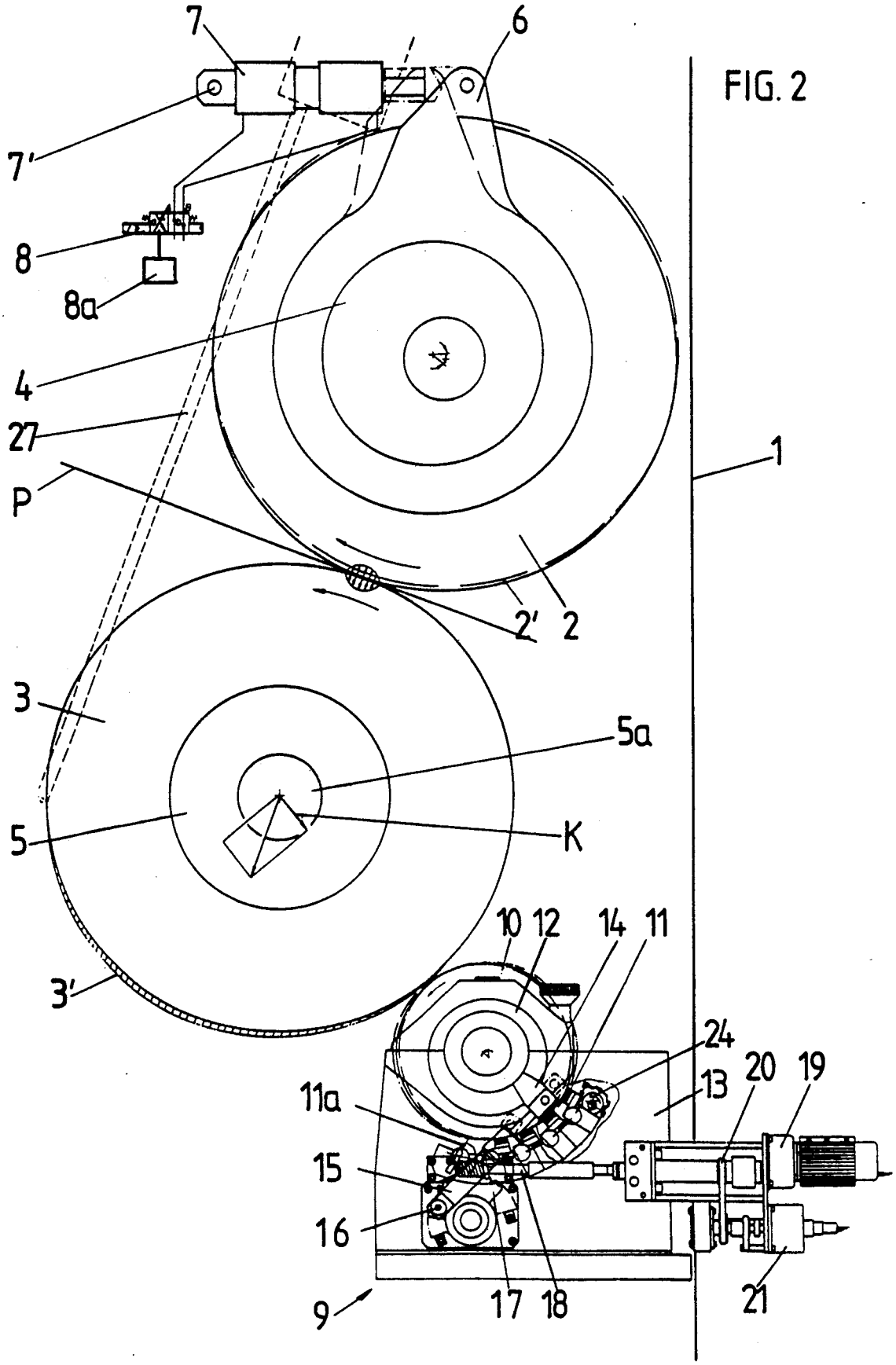
FIG. 2 shows the intaglio printing machine according to FIG. 1, illustrating the details essential for understanding the invention.
Figure 3:
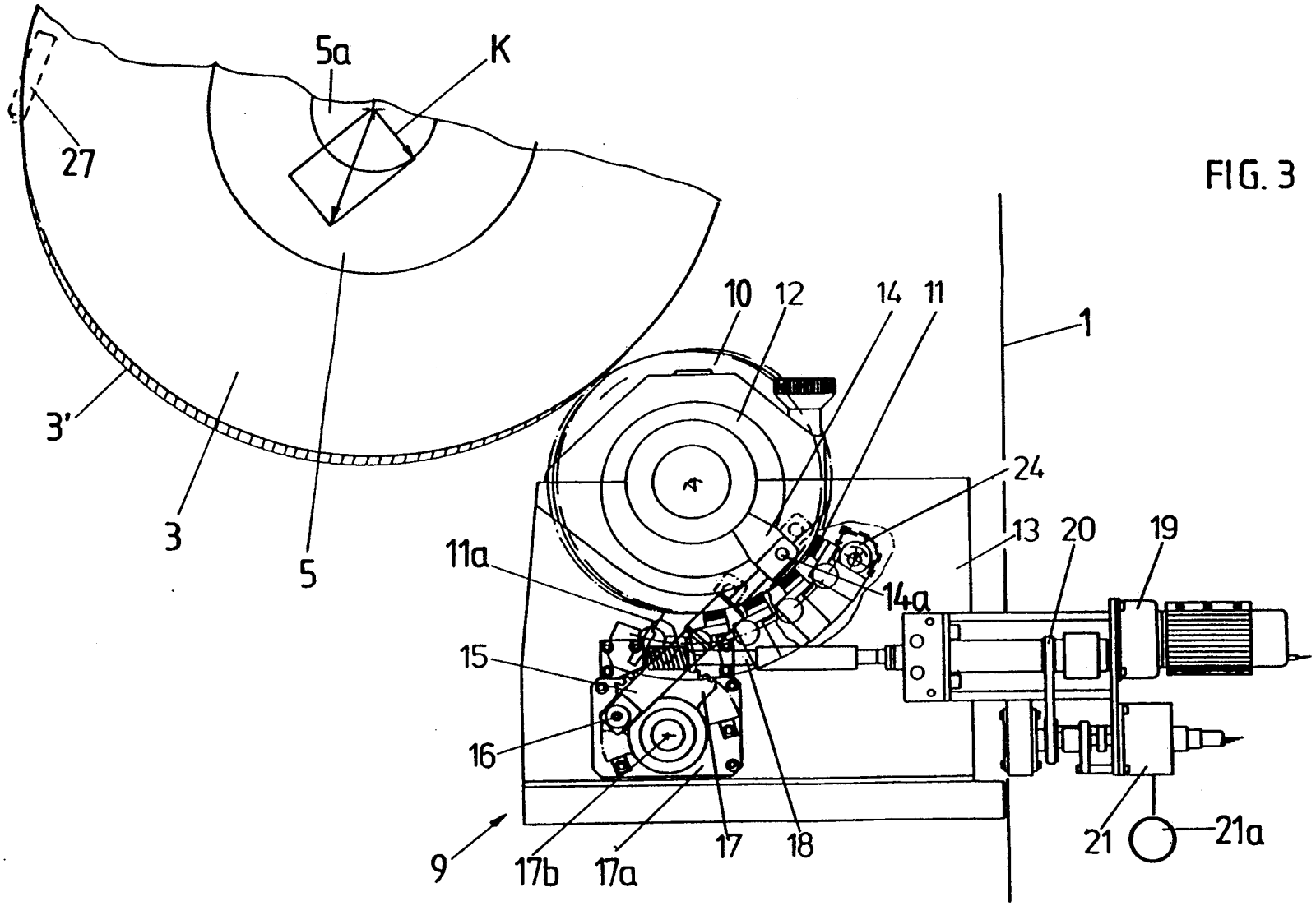
FIG. 3 shows an enlarged illustration of the plate cylinder and the wiping device with the device for adjusting the wiping cylinder.

As shown in FIG. 2, the paper sheets P to be printed are passed between the impression cylinder 2 and the plate cylinder 3, which rotate in the direction of the arrows, during the printing operation. The great pressure thereby required at the printing point is indicated diagrammatically in FIG. 2 by small arrows. The impression cylinder 2 is mounted in the solid side parts of the machine frame 1 by means of eccentric bushes 4, while the plate cylinder 3 is likewise mounted in this frame by means of concentric bushes 5. The eccentric bushes 4 of the impression cylinder 2 are fixedly connected at both ends to radially disposed levers 6. At the end of each lever 6, a hydraulic cylinder 7, which serves as actuator for engaging and removing the impression cylinder 2, is attached to the relevant outside of the machine frame. The operating position of the impression cylinder 2, in which it rests on the plate cylinder 3 with a predetermined force, is illustrated by uninterrupted lines in FIG. 2, while its removed position of rest is shown in dot/dashed lines. The fastening point 7' of the hydraulic cylinder 7 on the machine frame is adjustable, as a result of which the pressing force of the impression cylinder 2 can be set. The hydraulic cylinder 7 is controlled for engagement or disengagement of the impression cylinder 2 by an electrically actuated hydraulic valve 8 which, in turn, can be actuated by a command generator 8*a* which may be a pulse generator, which is controlled by a higher-ranking control system, or an operating switch.

In the operating position of the impression cylinder 2, as a result of the great pressure the cylinder journals 5*a* of the plate cylinder 3 undergo a deflection which is indicated diagrammatically by the downwardly offset circumferential section 3, of the plate cylinder 3. As depicted by the diagram of forces illustrated in the center of the plate cylinder 3, the effective force has a component K in the direction of the wiping cylinder 10 of the wiping device 9, so that the deflection has a corresponding displacement component pointing in the direction of the wiping cylinder 10, as a result of which the axle spacing between the plate cylinder 3 and wiping cylinder 10 is shortened.

The wiping cylinder 10 which is immersed in the wetting trough 13 and on which rest cleaning elements, in the example considered four brushes 11 and a doctor blade 11*a*, is mounted in the side walls of the wetting trough 13 by means of eccentric bushes 12, to which radially directed levers 14 arranged on both sides of the wetting trough 13 are fastened. The piston rod of a hydraulic cylinder 15 is attached in each case by means of a journal 14*a* to the ends of the levers 14. These hydraulic cylinders 15 are actuators, with which the wiping cylinder 10 can be adjusted by corresponding rotation of the eccentric bushes 12 between its operating position, illustrated in FIG. 3, in which it rests on the plate cylinder 3 with predeterminable pressure, and a removed position of rest.

Apart from this coarse adjustment of the wiping cylinder 10 by actuating the hydraulic cylinders 15, a fine adjustment is provided, with which the said deflection of the cylinder journals 5*a* of the plate cylinder 3 can be compensated. For this purpose, a worm wheel 17 is provided on each side of the wetting trough 13 and is mounted rotatably in a bearing plate 17*a* fixed to the wetting trough. The lower end of the relevant hydraulic cylinder 15 is suspended in an articulated manner by means of a journal 16 on this worm wheel 17, eccentrically to its axle 17*b*. Each of the worm wheels 17 is engaged with an essentially horizontally disposed worm spindle 18 which can be adjusted by a fine actuator 19 which, in the example considered, is an adjusting motor in the form of a stepping motor. By rotating the worm spindle 18, the suspension point, formed by the journal 16, of the hydraulic cylinder 15 and thus the eccentric bush 12 are adjusted so that, by suitable control of the stepping motor 19 within a fine-adjustment range, the wiping cylinder 10 can trail the plate cylinder 3 corresponding to the displacement thereof. The movement of the stepping motor 19 is transmitted by means of a toothed belt 20 to an actual value generator 21 and displayed digitally by means of a display device 21*a* so that the respective actual position of the wiping cylinder 10 can be checked.

Figure 4:
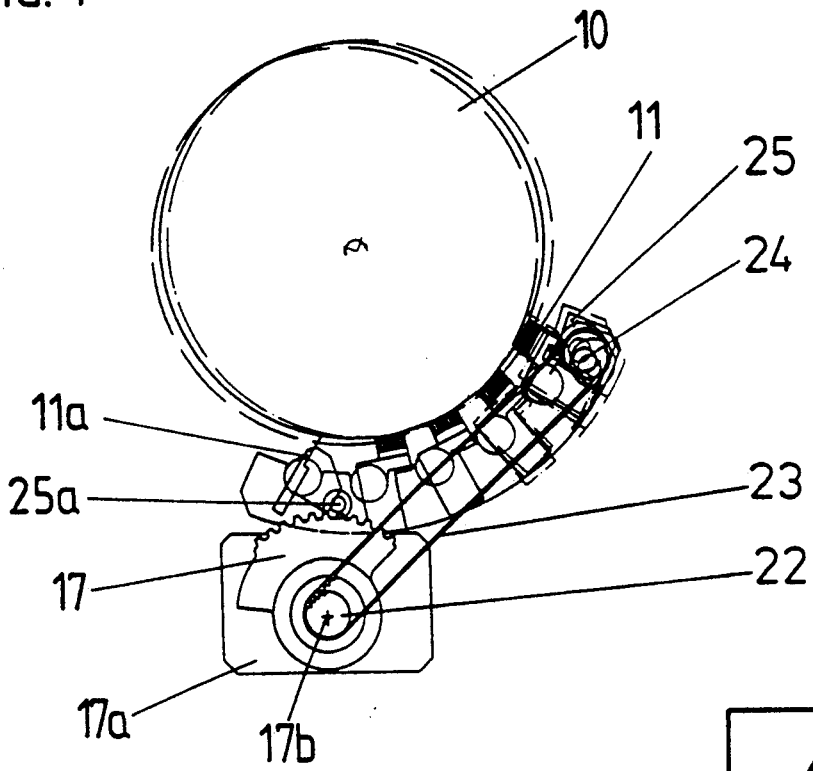
FIG. 4 shows a single view of the wiping cylinder according to FIG. 3 with the device for adjusting the cleaning elements.

In order to adapt the cleaning elements, that is to say the brushes 11 and the doctor blade 11*a*, to the changed position in this fine adjustment of the wiping cylinder 10, the cleaning elements are fastened on both sides of the wetting trough in each case to a support 25 in the form of a curved support segment (FIG. 4), which is mounted swivellably by means of a journal 25*a* on the inside of the wetting trough 13 at its end located nearest to the worm wheel 17 and is suspended at its other end on an eccentric bolt 24 which is likewise mounted rotatably on the wall of the wetting trough. A toothed belt 23 connects the eccentric bolt 24 to a gearwheel 22 which is mounted fixedly against rotation on the worm wheel 17 and is concentric thereto. In this manner, when the worm wheel 17 is adjusted not only the wiping cylinder 10, but, by means of the toothed belt 23, the eccentric bolt 24 and thus the support segment 25 with the cleaning elements are adjusted in such a way that their position relative to the wiping cylinder 10 is at least approximately maintained and, as a result, the correct resting of the cleaning elements on the wiping cylinder 10 is guaranteed for the purpose of satisfactory cleaning of the latter.

Figure 5:
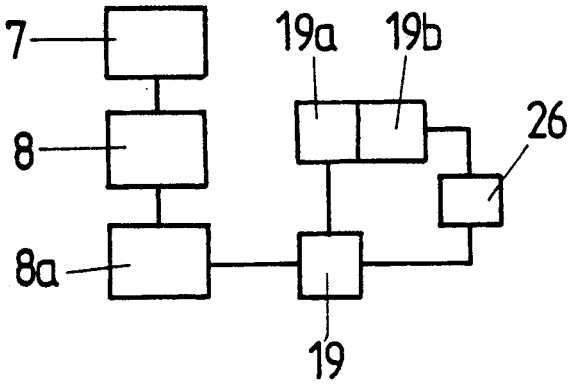
FIG. 5 shows a simplified block circuit diagram of the common control of the adjustments of the impression cylinder and wiping cylinder.

A preferred control of the trailing of the wiping cylinder 10 is explained with reference to the simplified block circuit diagram according to FIG. 5. In order to determine the required fine adjustment of the wiping cylinder 10, prior to the printing machine actually being put into operation those two positions of the stepping motor 19 are determined empirically in which the printing plates on the plate cylinder 3 are wiped satisfactorily by the wiping cylinder 10 in the removed position of rest of the impression cylinder 2 on the one hand, and, on the other hand, in the operating position of the impression cylinder, that is to say on engagement. This takes place by printing and inspecting test sheets at a selected position of the wiping cylinder and adjusting the wiping cylinder stepwise until the sheets are free from ink soiling. The manual setting or adjustment of the wiping cylinder during the determination of the optimum positions of the wiping cylinder preferably takes place by actuating pushbuttons which are provided on both sides of the wetting trough and are independent of one another. The difference between the two positions of the stepping motor 19 corresponding to the respective correct pressures of the wiping cylinder, expressed in the number of motor steps, represents the amount by which the wiping cylinder 10 is to be adjusted in either direction on engagement and on disengagement of the impression cylinder 2.

This difference is entered by means of a selector switch 19*b* into a preselection member 26 which is connected to the stepping motor 19. The preselection member 26 may be an electronic memory, for example. The stepping motor 19 as fine actuator can be actuated, on the one hand, manually by an operating element 19*a* and, on the other hand, by the command generator 8*a* which controls the engagement and disengagement of the impression cylinder 2 via the hydraulic valve 8 and the hydraulic cylinder 7. After storing the number of steps, corresponding to the said difference, in the preselection member 26, the command generator 8*a* thus ensures that the fine adjustment of the wiping cylinder 10 by the preselected amount in either direction always takes place simultaneously with the adjustment of the impression cylinder 2 when the latter is engaged on the plate cylinder 3 or disengaged therefrom.

Figure 6:
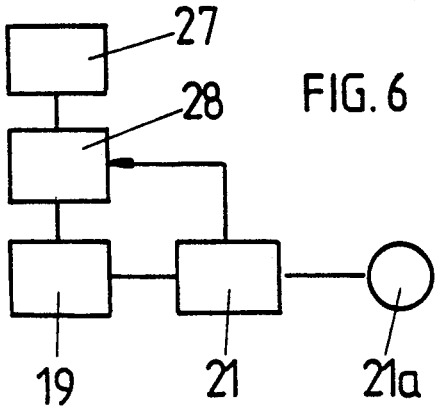
FIG. 6 shows a simplified block circuit diagram of an automatic control of the position of the wiping cylinder as a function of the pressing force of the impression cylinder.

In a further-developed embodiment of the printing machine according to the invention, a measuring device 27, which is illustrated only diagrammatically by dashed lines in FIG. 2, can be provided to measure the force with which the impression cylinder 2 rests on the plate cylinder 3. This measuring device 27 may, in particular, be a known strain gauge which establishes the deformation of the machine frame as a result of the pressing force of the two cylinders, which means the change in the spacing between the axles of the printing cylinder 2 and plate cylinder 3 on engagement and disengagement of the impression cylinder. With the aid of the measured value determined by a measuring device 27 of this type, further automation of the adjustment of the wiping cylinder can be undertaken. For this purpose, the respectively optimum fine adjustment of the wiping cylinder, in which the latter rests on the plate cylinder with the correct pressure, is determined as a function of the pressing force of the impression cylinder on the plate cylinder in the form of a program. The simplified block circuit diagram according to FIG. 6 shows one possible way of effecting the corresponding control. The measured value relayed by the measuring device 27 is fed via an analog-to-digital converter to a stored-program control system 28 which adjusts the stepping motor 19 via an associated algorithm for the purpose of trailing the wiping cylinder as a function of the pressure measurement. The signal which is generated by the measured-value generator 21, corresponds to the actual value of the position of the wiping cylinder and is also passed to the display device 21*a* and is returned to the control system 28 for the purpose of comparing the actual value with the desired value of the position of the wiping cylinder. In this case, the position of the wiping cylinder is thus regulated as a function of the pressing of the impression cylinder on the plate cylinder.

The invention is not restricted to the exemplary embodiments described, but is open to a multitude of variants, above all in respect of the design of the fine adjustment and control of the position of the wiping cylinder and also of the cleaning elements. The invention described for the case of a sheet-fed printing machine can also be used for web-fed printing machines and is always advantageous whenever the said angle cannot be selected at 90° for any reason.

We claim:

1. An intaglio printing machine comprising:

a plate cylinder (3), an impression cylinder (2), an actuator (7) for engagement and disengagement of said impression cylinder (2) by adjusting said impression cylinder between an operating position resting on said plate cylinder (3) and a resting position removed from said plate cylinder (3), a wiping device 9) which includes a wiping cylinder (10) which interacts with said plate cylinder (3), an actuator (15), said wiping cylinder being adjustable by means of said actuator (15) between an operating position, in which said wiping cylinder rests on said plate cylinder (3) with a predetermined pressure, and a resting position removed from said plate cylinder, wherein an angle between a connecting line of the axles of said impression cylinder and said plate cylinder and a connecting line of the axles of said plate cylinder and said wiping cylinder being other than 90 degrees, an additional fine actuator, said wiping cylinder (10) being adjustable within a fine-adjustment range by said additional fine actuator (19), said additional fine actuator acting directly on said wiping cylinder, an electric link between said actuator (7) for the impression cylinder and said fine actuator (19), said additional fine actuator (19) being actuated simultaneously with said actuator (7) for the impression cylinder by said electric link to maintain said predetermined pressure of said wiping cylinder (10) when said impression cylinder (2) is moved in and out of its operating position.

a journal of said plate cylinder, said journal being deflected by a large pressure force from engagement of said impression cylinder, whereby an original distance between the axle of said plate cylinder and the axle of said wiping cylinder is reduced, whereby reduction of said distance is compensated by said fine actuator (19) by displacing said axle of said wiping cylinder thereby maintaining said original distance and said predetermined pressure;

whereby when said impression cylinder (2) is moved to its rest position, deflection of said axle of said plate cylinder is eliminated and said fine actuator (19) displaces said wiping cylinder in an opposite direction thereto thereby keeping said original distance constant.

2. The intaglio printing machine as claimed in claim 1, wherein adjustment of said fine actuator (19) is determined by a preselection member (26), into which a preselected value corresponding to said reduced distance is entered, and wherein a command generator (8*a*) controls said fine actuator (19) and said actuator (7) for the impression cylinder thereby adjusting said impression cylinder (2).

3. The intaglio printing machine as claimed in claim 1, wherein said wiping cylinder (10) is mounted in adjustable eccentric bushes (12) and said actuator (15) corresponding to said wiping cylinder is formed by a hydraulic cylinder (15) for adjusting said eccentric bushes, and wherein fine adjustment of said wiping cylinder (10) is performed on each side of a worm wheel (17), to which said hydraulic cylinder (15) is fastened eccentrically in an articulated manner to an axle of said worm wheel, and a worm spindle (18) is driven by said fine actuator (19) by an adjusting motor.

4. The intaglio printing machine as claimed in claim 3, wherein said fine actuator (19) is a stepping motor.

5. The intaglio printing machine as claimed in claim 1, further including a display device (21*a*) for displaying an actual position of said wiping cylinder (10).

6. The intaglio printing machine as claimed in claim 1, in which said wiping cylinder (10) is immersed in a wetting trough (13) and is provided with cleaning elements (11, 11*a*), wherein said cleaning elements (11, 11*a*) are installed on a support (25) which is adjusted relative to a surface of said wiping cylinder, wherein said support is adjusted by said fine actuator (19), together with said wiping cylinder (10), wherein a position of said cleaning elements relative to said wiping cylinder is substantially retained.

7. The intaglio printing machine as claimed in claim 6, wherein each side of said adjustable support for said cleaning elements (11, 11*a*) includes a support segment which is swivellably mounted at a first end on an inside of said wetting trough (13) and seated at a second end on an eccentric bolt (24) which is fixed rotatably to said inside of said wetting trough (13), and wherein said eccentric bolt (24) is connected by a toothed belt (23) to a gearwheel (22), which is mounted concentrically on said worm wheel (17), whereby said eccentric bolt (24) is rotated and thereby said support segment is adjusted when said worm wheel is adjusted.

* * * * *